US009041706B2

(12) United States Patent
Shimizu et al.

(10) Patent No.: US 9,041,706 B2
(45) **Date of Patent: *May 26, 2015**

(54) THIN FILM TRANSISTOR CIRCUIT, LIGHT EMITTING DISPLAY APPARATUS, AND DRIVING METHOD THEREOF

(71) Applicant: CANON KABUSHIKI KAISHA, Tokyo (JP)

(72) Inventors: Hisae Shimizu, Tokyo (JP); Katsumi Abe, Kawasaki (JP); Ryo Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/148,123

(22) Filed: Jan. 6, 2014

(65) Prior Publication Data

US 2014/0125712 A1 May 8, 2014

Related U.S. Application Data

(63) Continuation of application No. 12/667,827, filed as application No. PCT/JP2008/063932 on Jul. 29, 2008, now Pat. No. 8,654,114.

(30) Foreign Application Priority Data

Aug. 10, 2007 (JP) ..... 2007-209984

(51) Int. Cl.
*G09G 5/00* (2006.01)
*G09G 3/32* (2006.01)

(52) U.S. Cl.
CPC ..... *G09G 3/3258* (2013.01); *G09G 3/3233* (2013.01); *G09G 2300/0417* (2013.01); *G09G 2300/0842* (2013.01); *G09G 2320/0233* (2013.01); *G09G 2320/043* (2013.01)

(58) Field of Classification Search
None
See application file for complete search history.

(56) References Cited

U.S. PATENT DOCUMENTS 5,324,928 A 6/1994 Saika et al.
6,351,160 B1 2/2002 Chan et al.

(Continued)

FOREIGN PATENT DOCUMENTS

JP 2005-512297 A1 4/2005
JP 2005-345722 A 12/2005

(Continued)

OTHER PUBLICATIONS

Taiwanese Office Action issue in counterpart application No. 097129849 dated Sep. 10, 2012, along with its English-language translation—11 pages.

(Continued)

*Primary Examiner* — Dismery Mercedes
(74) *Attorney, Agent, or Firm* — Fitzpatrick, Cella, Harper & Scinto

(57) ABSTRACT

In order to suppress an influence of an electrical stress on a TFT characteristic in use of a TFT, a light emitting display apparatus according to the present invention comprises organic EL devices and driving circuits for driving the organic EL devices. The driving circuit includes plural pixels each having a thin film transistor of which a threshold voltage reversibly changes due to the electrical stress applied between a gate terminal and a source terminal, and a voltage applying unit which sets gate potential of the thin film transistor higher than source potential. The voltage applying unit applies the electrical stress between the gate terminal and the source terminal at a time when the thin film transistor is not driven, so as to drive the thin film transistor in a region that the threshold voltage is saturated to the electrical stress.

7 Claims, 6 Drawing Sheets

(56) References Cited

U.S. PATENT DOCUMENTS

| | | | | |
|---|---|---|---|---|
| 6,734,636 | B2 * | 5/2004 | Sanford et al. | 315/169.3 |
| 7,071,932 | B2 * | 7/2006 | Libsch et al. | 345/211 |
| 7,612,749 | B2 * | 11/2009 | Libsch et al. | 345/82 |
| 7,675,493 | B2 | 3/2010 | Yoon et al. | |
| 7,760,168 | B2 * | 7/2010 | Ogura | 345/77 |
| 8,654,114 | B2 * | 2/2014 | Shimizu et al. | 345/212 |
| 8,659,519 | B2 * | 2/2014 | Abe et al. | 345/77 |
| 2003/0094616 | A1 * | 5/2003 | Andry et al. | 257/72 |
| 2003/0095087 | A1 | 5/2003 | Libsch et al. | |
| 2004/0174349 | A1 | 9/2004 | Libsch et al. | |
| 2005/0012686 | A1 | 1/2005 | Osame et al. | |
| 2006/0024867 | A1 * | 2/2006 | Paik | 438/149 |
| 2006/0187154 | A1 | 8/2006 | Tsuchida | |
| 2006/0208971 | A1 | 9/2006 | Deane | |
| 2007/0080906 | A1 * | 4/2007 | Tanabe | 345/76 |
| 2007/0267697 | A1 | 11/2007 | Tseng et al. | |
| 2007/0290973 | A1 * | 12/2007 | Wei | 345/92 |
| 2008/0150617 | A1 | 6/2008 | Fifield | |
| 2008/0157291 | A1 * | 7/2008 | Li et al. | 257/637 |
| 2009/0096725 | A1 * | 4/2009 | Kretz et al. | 345/82 |
| 2010/0001983 | A1 * | 1/2010 | Abe | 345/211 |

FOREIGN PATENT DOCUMENTS

| | | | |
|---|---|---|---|
| JP | 2006-208966 | A1 | 8/2006 |
| JP | 2006-525539 | A1 | 11/2006 |
| KR | 10-2006-0015571 | A | 2/2006 |
| WO | 2004/086343 | A1 | 10/2004 |
| WO | 2004/097782 | A1 | 11/2004 |

OTHER PUBLICATIONS

Japanese office action in corresponding application No. 2008-209984 date Aug. 21, 2012—4 pages including English translation.

Cross, R.B.M. et al., "Investigating the stability of zinc oxide thin film transistors," Applied Physics Letters, 89, 263513, 2006.

Chinese office action issued in corresponding application No. 200880102084.2 dated Dec. 1, 2011—9 pages with translation.

Korean office action issued in corresponding application No. 10-2010-7002892 dated Aug. 29, 2011—3 pages.

International Preliminary Report on Patentability issued in PCT/JP2008/063932, on Feb. 25, 2010, 5 pages.

Kenji Nomura et al., "Room-temperature fabrication of transparent flexible thin-film transistors using amorphous oxide semiconductors," Letter to Nature, vol. 432, pp. 488-492 (2004).

Hisato Yabuta et al., "High-mobility thin-film transistor with amorphous InGaZnO4 channel fabricated by room temperature rf-magnetron sputtering," Applied Physics Letters, vol. 89, pp. 112123-1-112123-3 (2006).

International Search Report issued in the corresponding International Application PCT/JP2008/063932 dated Sep. 22, 2008.

* cited by examiner

THIN FILM TRANSISTOR CIRCUIT, LIGHT EMITTING DISPLAY APPARATUS, AND DRIVING METHOD THEREOF

The present application is a continuation of U.S. application Ser. No. 12/667,827, which is a national phase entry of PCT/JP2008/063932, filed on Jul. 29, 2008, which claims priority to JP 2007-209984, filed Aug. 10, 2007, the entire disclosure of each of which is incorporated by reference herein.

TECHNICAL FIELD

The present invention relates to a thin film transistor circuit, a light emitting display apparatus, and the driving methods thereof. In particular, the light emitting display apparatus and the driving method thereof according to the present invention are suitably used respectively for a light emitting display apparatus which includes, like a matrix, pixels each composed of a light emitting device and a driving circuit for supplying current to the light emitting device, and for the driving method thereof. Here, it should be noted that, for example, an organic electroluminescence (EL) device can be used as the light emitting device.

BACKGROUND ART

Recently, an organic EL display using an organic EL device as a light emitting device has been studied and developed. In the organic EL display like this, an active-matrix (AM) organic EL display in which a driving circuit is provided in each pixel is generally used to extend the life span of the organic EL device and achieve high-quality image. The relevant driving circuit is constituted by a thin film transistor (TFT) formed on a substrate such as glass, plastic or the like. In the organic EL display, the substrate and the driving circuit portion are together called a back plane.

As the TFT of the back plane for the organic EL display, amorphous silicon (called a-Si hereinafter), polycrystal silicon (called p-Si hereinafter), or the like have been studied. In addition, a TFT in which an amorphous oxide semiconductor (called an AOS hereinafter) is used as its channel layer has newly been proposed recently. Here, for example, amorphous In(indium)-Ga(gallium)-Zn(zinc)-O(oxide) (called a-IGZO hereinafter) is used as the material of the AOS. Besides, for example, amorphous Zn(zinc)-In(indium)-O(oxide) (called a-ZIO hereinafter) is used as the material of the AOS. It is conceivable that the TFT in which the AOS is used as its channel layer has mobility which is ten times or more as much as that of an a-Si TFT and also has high uniformity which is caused by amorphousness. Therefore, the TFT in which the AOS is used as its channel layer is promising as the TFT of the back plane for the display. The TFT in which the AOS is used as its channel layer is disclosed in, for example, "Nomura, et al., Room-Temperature Fabrication of Transparent Flexible Thin Film Transistors using Amorphous Oxide Semiconductors, Nature, vol. 432, pp. 488-492 (2004)" and "Yabuta, et al., High-Mobility Thin-Film Transistor with Amorphous InGaZnO4 Channel Fabricated by Room Temperature RF-magnetron Sputtering, Appl. Phys. Lett. (APL), 89, 112123 (2006)".

In any case, there are several problems in case of achieving high-quality display by an active matrix (AM) organic EL display. More specifically, (1) a voltage-luminance characteristic of an organic EL device changes over time, (2) a characteristic of a TFT being the constituent element of a driving circuit varies from others, and (3) the characteristic of the TFT changes due to an electrical stress.

Here, in a case where an AOS-TFT is used for the driving circuit, the above problems (1) and (2) can be improved because uniformity of the AOS-TFTs is high and a driving circuit for controlling the currents supplied from the AOS-TFT to the organic EL device is employed.

On the other hand, since the characteristic of the AOS-TFT changes due to the electrical stress, the above problem (3) still remains.

DISCLOSURE OF THE INVENTION

The present invention aims to suppress deterioration of display quality according to a characteristic change of a TFT due to an electrical stress.

A driving method of the present invention, of a thin film transistor circuit which includes a thin film transistor of which a threshold voltage changes due to an electrical stress applied between a gate terminal and a source terminal, is characterized by comprising: applying the electrical stress between the gate terminal and the source terminal at a time when the thin film transistor is not driven, so as to drive the thin film transistor in a region that the threshold voltage is saturated to the electrical stress.

Further, a driving method of the present invention, of a light emitting display apparatus which includes plural pixels each having a light emitting device and a driving circuit for driving the light emitting device, is characterized in that the driving circuit includes at least one thin film transistor of which a threshold voltage reversibly changes due to an electrical stress applied between a gate terminal and a source terminal, and the driving method comprises applying the electrical stress between the gate terminal and the source terminal of the thin film transistor in a non-displaying period of the light emitting display apparatus, so as to drive the thin film transistor in a region that the threshold voltage is saturated to the electrical stress.

Furthermore, a thin film transistor circuit, of the present invention, which includes a thin film transistor of which a threshold voltage reversibly changes due to an electrical stress applied between a gate terminal and a source terminal, and a voltage applying unit to apply voltage between the gate terminal and the source terminal of the thin film transistor as the electrical stress, is characterized in that the voltage applying unit applies the electrical stress between the gate terminal and the source terminal at a time when the thin film transistor is not driven, so as to drive the thin film transistor in a region that the threshold voltage is saturated to the electrical stress.

Furthermore, a light emitting display apparatus, of the present invention, which includes plural pixels each having a light emitting device and a driving circuit for driving the light emitting device, is characterized in that: the driving circuit includes a thin film transistor of which a threshold voltage reversibly changes due to an electrical stress applied between a gate terminal and a source terminal, and a voltage applying unit to apply voltage between the gate terminal and the source terminal of the thin film transistor as the electrical stress; and the voltage applying unit applies the electrical stress between the gate terminal and the source terminal of the thin film transistor in a non-displaying period of the light emitting display apparatus, so as to drive the thin film transistor in a region that the threshold voltage is saturated to the electrical stress.

According to the present invention, since it is possible to use the thin film transistor (TFT) in the region that the threshold voltage is saturated to the electrical stress, it is possible to suppress an influence of a characteristic change of the TFT due to the electrical stress.

Further features of the present invention will become apparent from the following description of exemplary embodiments with reference to the attached drawings.

BEST MODE FOR CARRYING OUT THE INVENTION

The present inventors obtained the following knowledge by advancing an evaluation of an AOS-TFT (amorphous oxide semiconductor-thin film transistor).

That is, although the AOS-TFT has such a property of shifting threshold voltage by the electrical stress, the shift of this threshold voltage tends to be temporally saturated. The shift of the threshold voltage appears in a case that a gate potential is higher than a source potential. With respect to the shift of the threshold voltage of the AOS-TFT, there is such a property of returning to a condition before applying the electrical stress by eliminating the electrical stress and leaving the AOS-TFT for a certain period. That is, the AOS-TFT according to the present invention has been proposed on the basis of a property that the threshold voltage of the AOS-TFT reversibly changes by applying and eliminating the electrical stress. Note that the present invention can be applied to a TFT, of which the threshold voltage is changed by the electrical stress to be applied between a gate terminal and a source terminal, and is not limited to the AOS-TFT.

Hereinafter, as the embodiments of the present invention, a description will be given about an organic EL display apparatus (serving as a light emitting display apparatus), where a driver circuit has the AOS-TFT in which an a-IGZO is treated as a channel layer and organic EL devices serve as light emitting devices.

However, the present invention can be also applied to a light emitting display apparatus, where the AOS other than the a-IGZO is treated as a semiconductor, or a light emitting display apparatus, where light emitting devices other than the organic EL devices, for example, inorganic EL devices are used. In addition, the present invention can be widely used to thin film transistor circuits having TFTs of using amorphous oxide semiconductors as channel layers.

A thin film transistor circuit of the present invention has a thin film transistor, of which the threshold voltage is changed by the electrical stress to be applied between the gate terminal and the source terminal, and a voltage applying unit, which applies the voltage between the gate terminal and the source terminal of the thin film transistor as the electrical stress. The voltage applying unit applies the electrical stress between the gate terminal and the source terminal when the thin film transistor is not driven so as to drive the thin film transistor in a region that the threshold voltage is saturated to the electrical stress. Specifically, the voltage is applied between the gate terminal and the source terminal such that the gate potential becomes higher than the source potential in the thin film transistor. When the electrical stress is applied, the gate potential may be set to become equal to or higher than a drain potential in the thin film transistor.

Figure 9:
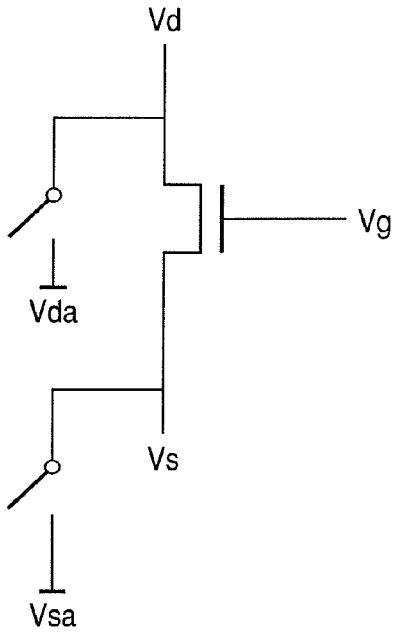
FIG. 9 is a circuit diagram indicating a case that the voltage is applied so as to lower drain and source potentials to a gate potential in a thin film transistor.

The voltage may be applied to the source terminal of the thin film transistor so as to lower to the gate potential. FIG. 9 is a circuit diagram indicating a case that the voltage is applied so as to lower the drain and source potentials to the gate potential in the thin film transistor. The voltage applying unit is constituted from two switches and two power sources $V_{sa}$ and $V_{da}$. At a time point of ordinarily using the thin film transistor, a voltage $V_g$ is applied to the gate terminal, a voltage $V_d$ is applied to the drain terminal and a voltage $V_s$ is applied to the source terminal. At a time point before using the thin film transistor, the gate potential $V_g$ can be kept higher than the source potential $V_s$ by switching on the power source $V_{sa}$ at a source terminal side and applying the voltage $V_s$ ($V_g>V_s$) to the source terminal with a state of applying the voltage $V_g$ to the gate terminal. In this case, the voltage $V_d$ may be applied to the drain terminal (it assumed that $V_g>V_d$ or $V_g=V_d$) upon switching on the power source $V_{da}$ at a drain terminal side.

As an AM device of using the AOS-TFT other than the light emitting display apparatus, it can be applied to, for example, a pressure sensor of using a pressure-sensitive device or an optical sensor of using a photosensitive device, and the similar effect can be obtained.

An amorphous described in the present invention is defined in that an obvious peak is not observed in an X-ray diffraction.

The organic EL display apparatus of the present invention has plural pixels having organic EL devices and driver circuits for driving the organic EL devices. A driver a-IGZO TFT for controlling a current to be supplied to the organic EL device and one or plural switches of changing the connection of the driver TFT are at least provided in the driver circuit. In addition, in a displaying period, the driver TFT operates in a region that the threshold voltage is saturated to the electrical stress. In the present embodiment, the region that the threshold voltage is saturated means a region that a change rate of the threshold voltage of a thin film transistor to the electrical stress is in a small level. Here, the region that a change rate of the threshold voltage is in a small level means a region that the change of the threshold voltage to the electrical stress does not influence the driving of the thin film transistor.

In the organic EL display apparatus of the present embodiment, a high level voltage is applied to the gate terminal and a low level voltage is applied to the source and drain terminals in the driver TFT by turning on and off a switch during a non-light emitting period, for example, in a case that a switch of the display is turned off. According to this operation, since the electrical stress is continuously applied to the driver TFT, the driver TFT can maintain a saturated region without recovering the shift of the threshold voltage. With respect to application of the electrical stress, the voltage may be continuously or intermittently (for example, plural-time pulses) applied.

Thereafter, if a displaying operation is performed again, the driver TFT is to operate in a region that the threshold voltage is saturated. Therefore, in the organic EL display apparatus of the present embodiment, the shift of the threshold voltage to the electrical stress in the TFT can be reduced to a small level, and the deterioration of display quality can be suppressed.

In addition, it is preferable that the organic EL display apparatus of the present invention performs an operation of applying the voltage to the driver TFT by the time at least 48 hours before starting to use the display apparatus and more preferably by the time 24 hours before starting to use the display apparatus after the display apparatus was fabricated. By performing the present operation, the driver TFT can be operated in a region that the threshold voltage is saturated to the electrical stress from the time of starting to use the display apparatus.

In addition, it is more preferable that the organic EL display apparatus of the present embodiment equips an accessory battery. By equipping the accessory battery, even if in a case that the display apparatus is not connected to an external power source in moving, an operation of applying the electrical stress can be performed. Since an operation of applying the voltage to the driver TFT does not almost require the current supply, the power consumption in operating results in a little consumption.

Embodiment 1

First, the characteristic of a TFT, in which the a-IGZO to be used in the present embodiment is treated as a channel layer, will be described.

A fabricating method of the a-IGZO TFT will be indicated as below.

Figure 1:
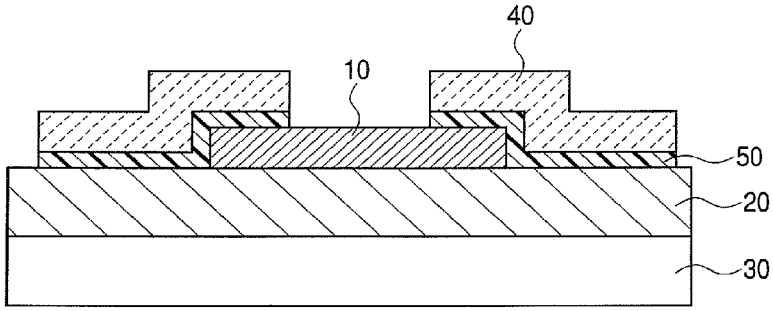
FIG. 1 is a view indicating the constitution 1 (on Si substrate) of an a-IGZO TFT in the Embodiment 1 of the present invention.

As indicated in FIG. 1, a thermally-oxidized $SiO_2$ insulation film 20, of which thickness is 100 nm, is formed on an Si substrate 30, to which impurity such as P (phosphorus) or As (arsenic) is densely injected. Here, a part of the Si substrate 30 constitutes a gate electrode.

Thereafter, an a-IGZO film 10, of which thickness is 50 nm, is deposited in the room temperature by a sputter deposition method by treating a polycrystalline IGZO as a target. Next, a channel layer is formed by patterning the a-IGZO film 10 by a wet etching process depending on a photolithography method and the dilute hydrochloric acid.

Subsequently, after depositing a Ti payer (5 nm) 50 and an Au layer (40 nm) 40 by an EB (electron beam) vapor deposition method upon patterning the resist by the photolithography method, source and drain electrodes of Au/Ti are formed by a lift-off method.

Then, an annealing process is further executed for an hour at the temperature of 300° C.

According to the above process, the a-IGZO TFT as indicated in FIG. 1 can be formed.

An electric characteristic of the a-IGZO TFT which can be obtained by the above-described fabricating method will be indicated.

Figure 2:
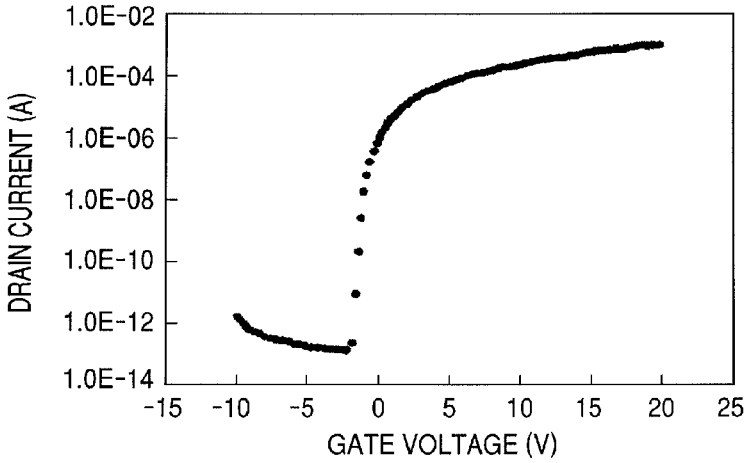
FIG. 2 is a view indicating an Id-Vg (drain current versus gate voltage) characteristic of the constitution 1 of the a-IGZO TFT in the Embodiment 1 of the present invention.

FIG. 2 indicates the Id-Vg characteristic of the present TFT. The present TFT, of which the channel width is 80 μm, the channel length is 10 μm, the threshold voltage is −0.1V and the mobility is 18 $cm^2/Vs$, has such the mobility which is ten times larger than that of an ordinary a-Si TFT.

Figure 3:
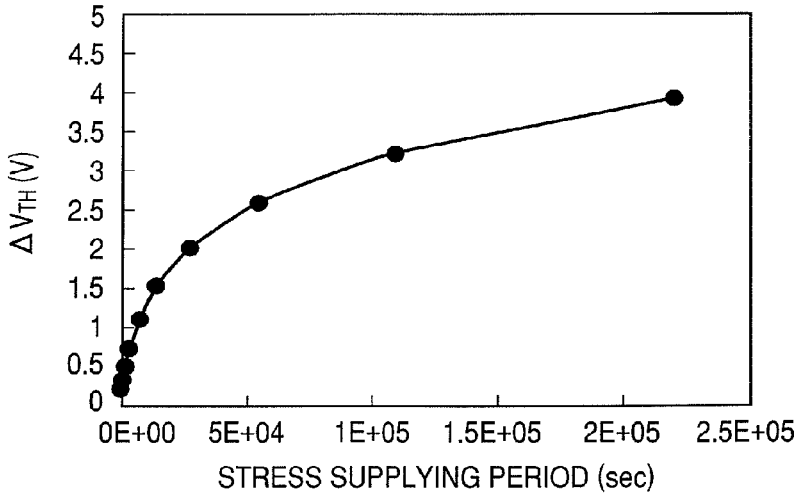
FIG. 3 is a view indicating the threshold change by the electric stress of the constitution 1 of the a-IGZO TFT in the Embodiment 1 of the present invention.

The threshold voltage change ($\Delta V_{TH}$) in a case that a portion between the gate terminal and the drain terminal is short-circuited to the present TFT and a constant current of 27 μA is applied between the drain terminal and the source terminal is indicated in FIG. 3. A lateral axis in FIG. 3 denotes a time of applying the electrical stress. At this time, the gate potential is made higher than the source potential. And, the gate potential is made equal to the drain potential. For example, a notation of 5E+04 marked on the lateral axis in FIG. 3 denotes $5\times10^4$.

In this case, a constant voltage is applied to the gate terminal and the drain terminal. In addition, a variable power source is provided on the source terminal such that a constant current flows between the drain terminal and the source terminal. That is, since the current flows between the drain terminal and the source terminal is determined by the potential difference between the gate terminal and the source terminal, the voltage of the power source provided on the source terminal is adjusted such that the current flows between the drain terminal and the source terminal becomes a constant current.

And, from a fact that a voltage of the gate terminal is larger than a voltage of the source terminal, the electrical stress is applied to the TFT. In this case, the threshold voltage of the TFT gradually increases. Therefore, in order to set the current, which flows between the drain terminal and the source terminal, to a constant current, it is required to increase the potential difference between the gate terminal and the source terminal. For this reason, it is adjusted such that a voltage of the power source provided on the source terminal becomes small voltage as the stress applying time is increased.

As compared with a fact that threshold voltage variation is about 1V during a period from a time of elapsing twenty hours (about 70000 seconds) to a time of elapsing sixty hours, the threshold voltage varies about 3V during a period from a time of starting the measurement to the time of elapsing about 70000 seconds. Therefore, it is considered that when the stress applying time reaches a certain level, the change rate of the threshold voltage by the electrical stress approaches a constant level. In a case indicated in FIG. 3, for example, a region that the threshold voltage variation is about 1V (after elapsing about 70000 seconds) is a saturation region of the threshold voltage, and the TFT is driven in this region.

Incidentally, FIG. 3 indicates an example of the relationship between the stress applying time and the threshold voltage in a case that the electrical stress was applied to a thin film transistor of using an amorphous oxide semiconductor. The relationship between the stress applying time and the threshold voltage varies depending on the property of the amorphous oxide semiconductor to be used and the stress applying condition (voltage, temperature or the like).

Figure 4:
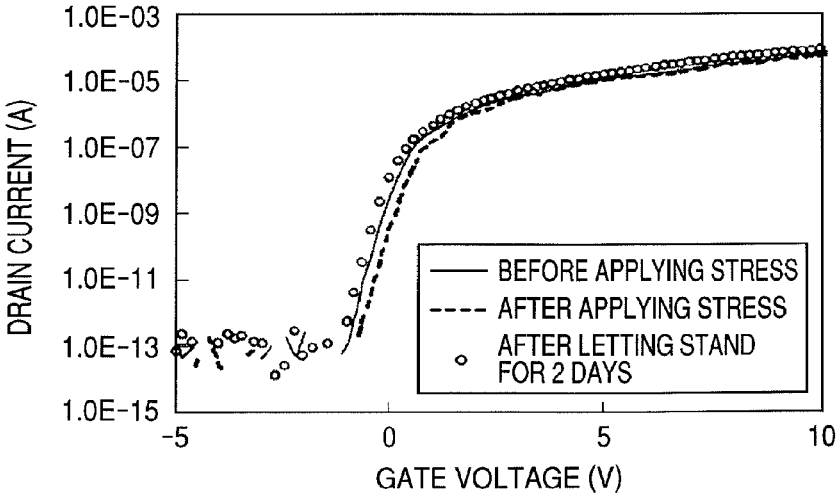
FIG. 4 is a view indicating the recovery characteristic of the recovery from the changed situation of the constitution 1 of the a-IGZO TFT in the Embodiment 1 of the present invention.

A waveform of the Id-Vg characteristic before and after applying the electrical stress of the gate voltage 12V, the drain voltage 6V and the source voltage 0V to another a-IGZO TFT (channel width is 180 μm and channel length is 30 μm) obtained by the above-described method for 800 seconds is indicated in FIG. 4. A waveform of the Id-Vg characteristic of the same TFT after storing it in a dark place for two days after that is similarly indicated in FIG. 4. According to this FIG. 4, in case of storing it in a dark place for two days (48 hours), the change of the threshold voltage by the electrical stress is recovered. That is, it is indicated that the influence by the electrical stress remains during a period equal to or less than 48 hours. Consequently, it is understood that the threshold voltage is reversibly changed by the electrical stress to be applied between the gate terminal and the source terminal.

Figure 5:
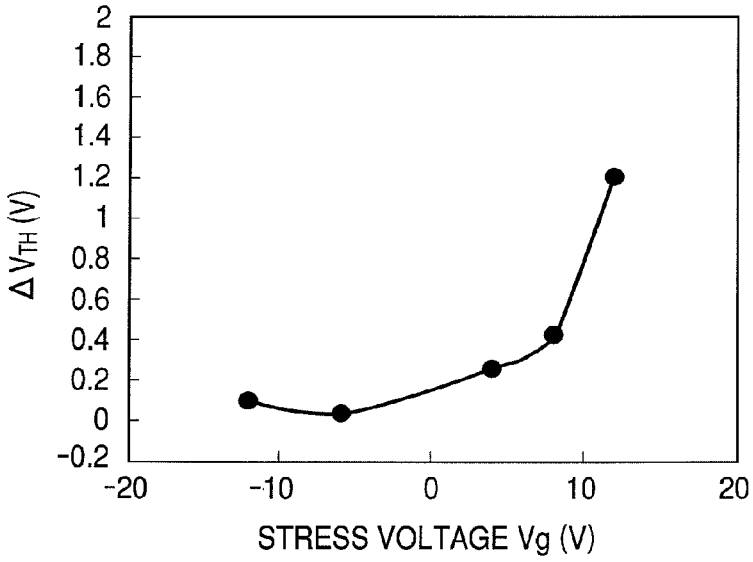
FIG. 5 is a view indicating the gate voltage dependency of the stress change of the constitution 1 of the a-IGZO TFT in the Embodiment 1 of the present invention.

In addition, the electrical stress is applied to another a-IGZO TFT (channel width is 180 μm and channel length is 30 μm) obtained by the above-described method for 400 seconds in some gate voltages upon fixing the drain voltage to 6V and the source voltage to the GND. Kinds of gate voltages are five ways of −12V, −6V, 4V, 8V and 12V. FIG. 5 indicates the threshold voltage variation by the electrical stress. According to this FIG. 5, the threshold change is almost never observed in a case that the gate voltage is lower than the source voltage (equal to or less than 0V). Further, in a case that the gate voltage is higher than the source voltage and the drain voltage (12V), the threshold change is resulted to become the largest change.

Figure 10:
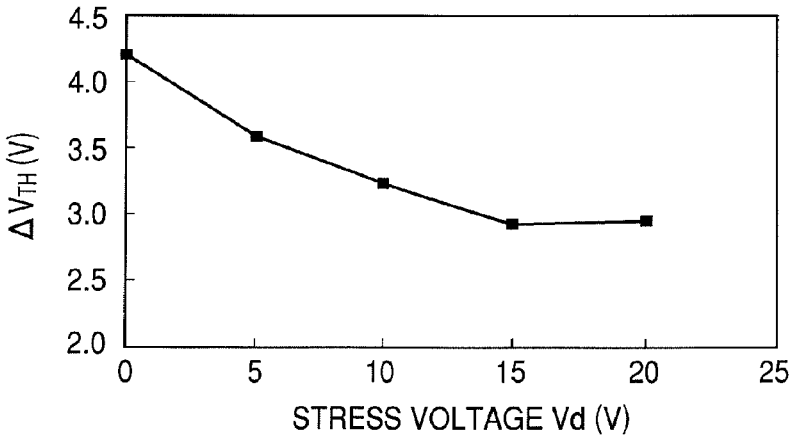
FIG. 10 is a view indicating the change of threshold voltage in case of changing the drain voltage.

In addition, the electrical stress is applied to the a-IGZO TFT (channel width is 180 μm and channel length is 30 μm) for 400 seconds in some drain voltages upon fixing the gate voltage to 20V and the source voltage to the GND. FIG. 10 indicates the threshold voltage variation in case of changing the drain voltage. According to this FIG. 10, it is understood that the threshold change becomes small as the drain voltage approaches the gate voltage (20V).

Figure 6:
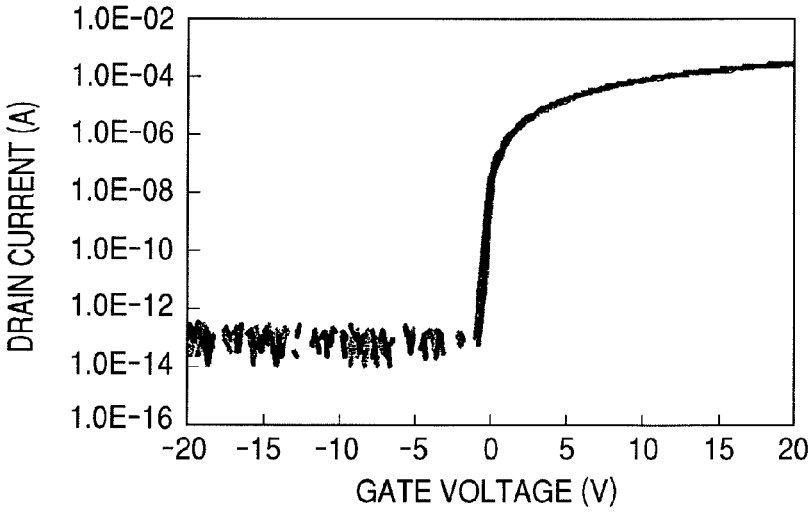
FIG. 6 is a view indicating the plural Id-Vg characteristics of the constitution 1 of the a-IGZO TFT in the Embodiment 1 of the present invention.

Additionally, the Id-Vg characteristic of the a-IGZO TFT, of which the channel width is 180 μm and the channel length is 30 μm, obtained by the above-described method is indicated in FIG. 6. FIG. 6 is a view of overwriting Id-Vg characteristics of eight TFTs, and uniformity of the characteristics becomes more high level when the overwritten characteristics can be more seen almost in one characteristic.

Figure 7:
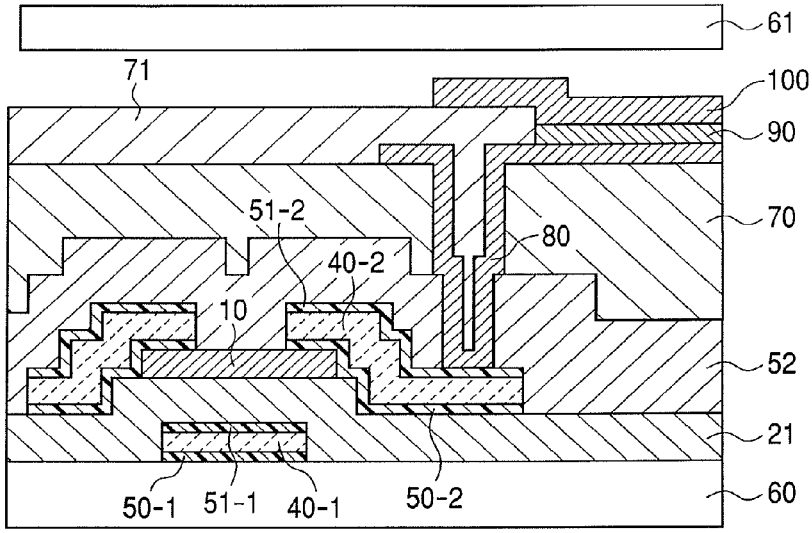
FIG. 7 is a view indicating the constitution 2 (on glass substrate) of the a-IGZO TFT in the Embodiment 1 of the present invention.

By using the a-IGZO TFT exhibiting the above characteristic, an organic EL display apparatus indicated in FIG. 7 will be fabricated by the following method.

First, a Ti/Au/Ti stack film consisted of a Ti layer 50-1, an Au layer 40-1 and a Ti layer 51-1 is deposited by a vapor deposition method on a glass substrate 60 as a gate line and a gate electrode. The pattern forming for the Ti/Au/Ti stack film is performed by using a photolithography method and a lift-off method.

Next, an $SiO_2$ film is deposited by a sputtering method as an insulation layer 21. The pattern forming for the $SiO_2$ film is performed by the photolithography method and a wet etching method of using the buffered hydrofluoric acid.

Subsequently, the a-IGZO film 10 is formed by the sputtering method as a channel layer. The pattern forming for the a-IGZO film 10 is performed by the photolithography method and the wet etching method of using the dilute hydrochloric acid.

Subsequently, a Ti/Au/Ti stack film consisted of a Ti layer 50-2, an Au layer 40-2 and a Ti layer 51-2 is deposited by the vapor deposition method as data wirings and source-drain electrodes. The pattern forming for the Ti/Au/Ti stack film is performed by using the photolithography method and the lift-off method.

Subsequently, an $SiO_2$ film 52 is deposited as an interlayer insulation film. The pattern forming for the $SiO_2$ film 52 is performed by the photolithography method and the wet etching method of using the buffered hydrofluoric acid.

Subsequently, a photosensitive polyimide film 70 is deposited by a spin coat method as a planarization film. The patterning for the photosensitive polyimide film 70 can be performed by executing an exposure process by the photolithography method and executing a separating process, because the photosensitive polyimide is used.

Subsequently, an organic EL device is formed.

First, an ITO (indium tin oxide) film 80 is deposited by the sputtering method as an anode electrode. The pattern forming for the ITO film 80 is performed by the photolithography method and the wet etching method of using an ITO stripping solution or a dry etching method.

Subsequently, a photosensitive polyimide film 71 is deposited by the spin coat method as a device separation film. The patterning for the photosensitive polyimide film 71 can be performed by executing the exposure process by the photolithography method and executing the separating process, because the photosensitive polyimide is used.

Subsequently, an organic film 90 is deposited by the vapor deposition method as a light emitting layer. The pattern forming for the organic film 90 is performed by a metal mask method.

Subsequently, an Al film is deposited by the vapor deposition method as a cathode electrode 100. The pattern forming for the Al film is performed by the metal mask method.

At last, an organic EL display apparatus can be fabricated (FIG. 7) by performing the glass sealing by using a glass substrate 61.

Figure 8:
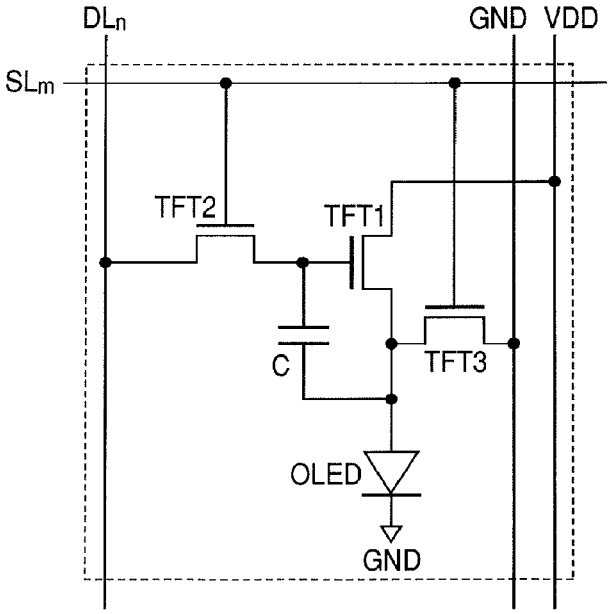
FIG. 8 is a view indicating a pixel circuit in the Embodiment 1 of the present invention.
Figure 11:
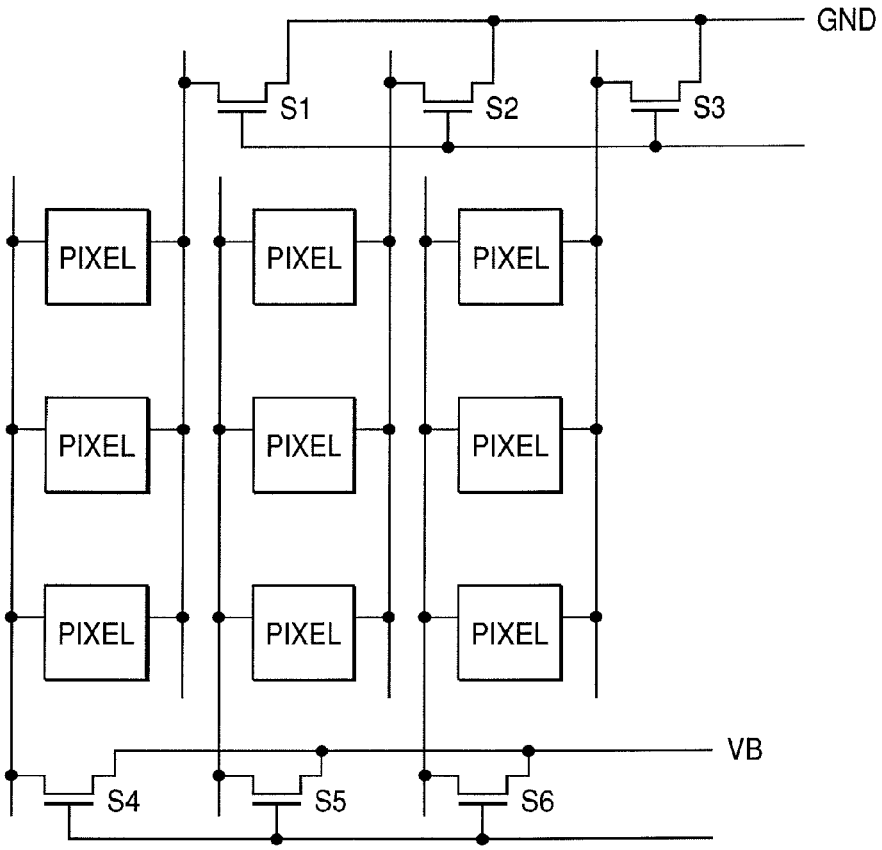
FIG. 11 is a view indicating a pixel region of an organic EL display apparatus of the present embodiment.

FIG. 8 indicates a pixel circuit in the organic EL display apparatus of the present embodiment. The pixel circuit corresponds to a circuit constituting part surrounded by a broken line excepting an organic EL device (OLED (organic light emitting diode)). FIG. 11 indicates a pixel region of the organic EL display apparatus of the present embodiment. In FIG. 11, reference symbols S1 to S6 denote switches which serve to operate the voltage applying means, and a pixel is composed of the organic EL device (OLED) and the pixel circuit. In the present embodiment, the pixel circuit serving as a driver circuit is constituted by three a-IGZO TFTs (TFT1, TFT2 and TFT3) and a capacitor C exists between the gate terminal and the source terminal of the TFT1. The TFT1 is a driver TFT for controlling a current to be supplied to the organic EL device (OLED) and the TFT2 and the TFT3 operate as switches.

Initially, an operation in an ordinary display period in the present embodiment will be described. Here, although an operation of a pixel positioned on a place defined by the m-row and the n-column will be described, an operation of another pixel is same as that of the above-described pixel. In the ordinary display period, the switches S1 to S6 are in an OFF state.

In a period that a scanning line $SL_m$ is selected, a high level voltage is applied to the scanning line $SL_m$, and the TFT2 and the TFT3 are switched ON. During that selection period, the gray-scale voltage is applied to the gate terminal of the TFT1 from a data line $DL_n$ via the TFT2. And, the GND voltage is applied to the source terminal of the TFT1 from a GND line via the TFT3. Thereafter, when a scanning line of a next stage is selected, a low level voltage is applied to the scanning line $SL_m$, and the TFT2 and the TFT3 are switched OFF. At this time, with respect to the voltage between the gate terminal and the source terminal of the TFT1, the gray-scale voltage in a selection period is held by the capacitor C. As long as the TFT1 operates in a saturation region, a current to be flown in the TFT1 is determined by the gray-scale voltage. Therefore, a current to be supplied to the OLED, that is, the luminance of the OLED can be controlled by the magnitude of the present gray-scale voltage.

The selection of the above-described scanning line is performed sixty times per second for all the scanning lines on the display. That is, one frame period corresponds to a ratio of 1/60 seconds.

Next, an operation in a non-displaying period in the present embodiment will be described. Although an operation of a pixel positioned on a place defined by the m-row and the n-column will be described, an operation of another pixel is same as that of the above-described pixel.

In the organic EL display apparatus of the present embodiment, all the scanning lines of $SL_m$ and the data lines of $DL_n$ are selected in at least a part of the non-displaying period, and the TFT2 and the TFT 3 are switched ON. And, a constant voltage VB higher than the GND voltage is applied to the data line $DL_n$ upon turning ON the switches S4 to S6. Further, the drain voltage of the TFT1, that is, the voltage Vdd is set to the GND voltage upon turning ON the switches S1 to S3.

At this time, a current does not flow in the OLED, meanwhile the electrical stress is continuously applied to the TFT1. Consequently, the TFT1 is held with a state that a value of the threshold voltage for the electrical stress is saturated.

By performing the above operation, the organic EL display apparatus of the present invention can operate the a-IGZO TFT in a saturated region of the threshold voltage for the electrical stress. As a result, the deterioration of image quality due to the electrical stress can be suppressed.

Note that since the TFT2 and the TFT3 operate as switches, even if the threshold voltage is shifted, the TFT can be driven if the driving voltage of the TFT is previously set to a predetermined value. Therefore, although it is not always required to apply the electrical stress to the TFT2 and the TFT3, when the driving voltage of the TFT is desired to be set to a constant voltage, that is, when the influence by the variation of the threshold voltage is desired to be suppressed, the electrical stress may be applied similar to a case of the TFT1.

Embodiment 2

An organic EL display apparatus of the present embodiment further includes a battery in the organic EL display apparatus of the Embodiment 1, and an operation of applying the electrical stress is enabled to be performed in at least a part of the non-displaying period indicated in the Embodiment 1 without supplying the power from an external.

After completing to fabricate the product, the TFT1 can be realized to operate in the saturated region of the threshold voltage for the electrical stress by applying the electrical stress. Additionally, the TFT1 can be kept in a state of operating in a region that the change for the electrical stress is saturated until a time before starting to use by performing an operation in the above-described non-display state by using the battery.

Furthermore, by providing the battery, the TFT1 can be kept in a state of operating in the region that the change for the electrical stress is saturated even if in a case that the organic EL display apparatus is separated from the power source and is moved.

However, since the recovery of the above-described characteristic comes about after elapsing a time equal to or longer than 48 hours, it is desirable to avoid to space the time equal to or longer than 48 hours concerning the above-described operation from a time of starting to use. More preferably, it has to be avoided to space a time to be fixed within 24 hours.

In an operation of the above-described non-display state, since there is not a route of flowing a current excepting a leak current, the power supplied from the battery to be used to perform the operation in the above-described non-display state is a small power. Therefore, in case of mounting the organic EL display apparatus of the present embodiment on an apparatus having a battery such as a notebook PC or a mobile phone, the influence for a period available to supply the power of the battery caused by performing the operation in the above-described non-display state is very few.

In case of applying the electrical stress after completing to fabricate the product, a time taken for the TFT1 to reach a region that the threshold voltage is saturated to the electrical stress can be shortened by applying the temperature together with the electrical stress.

As above described, in the present embodiment, the deterioration of display quality by the electrical stress can be suppressed in the organic EL display apparatus having driver circuits in which the a-IGZO TFTs serve as the constituent.

Although the description only concerning the TFT, in which the a-IGZO film is treated as a channel layer, was given in the Embodiments 1 and 2, the present invention can be also applied to the AOS-TFT having the similar characteristic to the electrical stress.

In addition, in case of realizing a display apparatus more excellent in the multi gray-scale, even if a driver circuit having a threshold correction function or a driver circuit having the current mirror constitution is adopted, the same effect can be obtained by applying the voltage to the driver TFT in the non-displaying period as described above.

In addition, in the Embodiment 2, the power necessary for applying the voltage is supplied from a battery equipped with the light emitting display apparatus or equipped with a system including the display apparatus, and the voltage is applied in a non-light emitting period without supplying the power from an external power source of the light emitting display apparatus. Herewith, the voltage can be applied even if the external power source is not provided.

The present invention can be applied to a light emitting apparatus having an AOS-TFT in which a driver circuit of a light emitting device functions to treat the AOS as a channel layer. The present invention can be also applied to an AM device of using the AOS-TFT other than the light emitting display apparatus, for example, a pressure sensor of using a pressure-sensitive device or an optical sensor of using a photosensitive device.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Application No. 2007-209984, filed Aug. 10, 2007, which is hereby incorporated by reference herein in its entirety.

The invention claimed is:

1. A light emitting display apparatus comprising:

a plurality of pixels each provided by a light emitting device and a driving circuit including a thin film transistor for controlling a current to be supplied to the light emitting device by applying a voltage between a gate terminal and a source terminal during a displaying period of the light emitting display apparatus; and a voltage applying unit for applying voltages to the thin film transistor during a non-displaying period of the light emitting display apparatus, wherein the thin film transistor has a property of shifting threshold voltage by an electrical stress to be applied between the gate terminal and the source terminal, and wherein the voltage applying unit applies a voltage to the drain terminal being-equal to a voltage of the source terminal, and applies a voltage between the gate terminal and the source terminal during the non-displaying period of a same polarity as the voltage between the gate terminal and the source terminal applied in the displaying period.

2. The light emitting display apparatus according to claim 1, wherein the light emitting display apparatus further comprises a scanning line, a ground line, a power supplying line, and a data line, and the driving circuit further includes a first switch connected between the gate terminal of the thin film transistor and the data line, a second switch connected between the source terminal of the thin film transistor and the ground line, and a capacitor connected between the gate terminal and the source terminal of the thin film transistor, wherein the first and the second switches are controlled by the scanning line, and wherein the drain terminal of the thin film transistor is connected to the power supplying line and the source terminal of the thin film transistor is connected to one end of the light emitting device, the other end of which is connected to a ground level.

3. The light emitting display apparatus according to claim 2, wherein during the displaying period of the light emitting display apparatus, scanning lines are selected sequentially to switch ON the first and second switches so that a gray-scale voltage is applied to the gate terminal from the data line via the first switch and the ground voltage is applied to the source terminal via the second switch so that the gray-scale voltage is held in the capacitor and after the first and second switches are switched OFF, a current corresponding to the gray-scale voltage is supplied to the light emitting device.

4. The light emitting display apparatus according to claim 2, wherein the voltage applying unit includes a plurality of third switches each connecting the power supplying line to the ground level and a plurality of fourth switches each connecting the data line to a voltage source a voltage of which is higher than the ground level, and wherein during the non-displaying period of the light emitting display apparatus, the scanning lines are simultaneously selected to cause the first and second switches turn ON and the third and fourth switches are turned ON, so that the ground potential is applied to the source and the drain terminal of the thin film transistor via the second and the third switches, respectively, and the voltage higher than the ground level is applied to the gate terminal of the thin film transistor via the first and fourth switches.

5. The light emitting display apparatus according to claim 1, wherein the thin film transistor uses an amorphous oxide semiconductor as a channel layer.

6. The light emitting display apparatus according to claim 5, wherein the light emitting device uses an organic EL device.

7. The light emitting display apparatus according to claim 1, wherein the voltage applied by the voltage applying unit is supplied from a battery.

* * * * *